US005362296A

United States Patent [19]

Wang et al.

[11] Patent Number: 5,362,296

[45] Date of Patent: Nov. 8, 1994

[54] CHAIR MOUNTING EXERCISING UNIT

[75] Inventors: Leao Wang; Peter Wu, both of Taichung Hsien, Taiwan, Prov. of China

[73] Assignee: Greenmaster Idustrial Corp., Taiping Hsiang, Taiwan, Prov. of China

[21] Appl. No.: 223,466

[22] Filed: Apr. 5, 1994

[51] Int. Cl.[5] ..... H63B 21/00

[52] U.S. Cl. ..... 482/133; 482/130; 482/121; 482/123

[58] Field of Search ..... 482/904, 133, 129–130, 482/51, 72, 93, 99, 101, 121, 124, 122–123, 142; 601/24, 49

[56] References Cited

U.S. PATENT DOCUMENTS

| | | | |
|---|---|---|---|
| 3,709,487 | 1/1973 | Walker | 482/133 |
| 4,231,568 | 11/1980 | Riley et al. | 482/130 |
| 4,632,390 | 12/1986 | Richey | 482/133 |
| 4,913,423 | 4/1990 | Farran et al. | 482/130 |
| 4,921,247 | 5/1990 | Sterling | 482/130 |
| 5,044,633 | 9/1991 | Rice | 482/130 |
| 5,080,353 | 1/1992 | Tench | 482/130 |
| 5,176,601 | 1/1993 | Reynolds | 482/130 |
| 5,201,694 | 4/1993 | Zappel | 482/133 |

FOREIGN PATENT DOCUMENTS

| | | | |
|---|---|---|---|
| 0220034 | 3/1910 | Germany | 601/24 |

*Primary Examiner*—Richard J. Apley
*Assistant Examiner*—Jerome Donnelly
*Attorney, Agent, or Firm*—Bacon & Thomas

[57] ABSTRACT

A chair mounting exercising unit includes two swinging arms having a bottom end fastened to either end of a substantially U-shaped locating rod being fixed to the back of a chair by a knob controlled lock device and a slotted side extension plate in the middle at an outer side movably hung on a screw bolt at either end of a horizontal frame on the back of the chair and a top end coupled with a pulley wheel assembly, and two elastic pull ropes respectively inserted through either pulley wheel assembly and fastened to either swinging arm and an opposite end coupled with a handle.

3 Claims, 7 Drawing Sheets

CHAIR MOUNTING EXERCISING UNIT

BACKGROUND OF THE INVENTION

The present invention relates to exercising apparatus, and more particularly to an exercising unit mounted on the back of the chair of an exercising apparatus for exercising the muscles of the chest and the back.

Various exercising apparatus have been disclosed for exercising different parts of the body, and have appeared on the market. These apparatus are commonly heavy and expensive. It has been the tendency to provide a versatile exercising apparatus having a simple structure. However, increasing the functions of an exercising apparatus will relatively complicate the structure and increase the manufacturing cost.

SUMMARY OF THE INVENTION

The present invention provides a chair mounting exercising apparatus which can be mounted on a regular exercising apparatus to increase its functions, or separately installed as an independent exercising apparatus. According to the preferred embodiment of the present invention, the chair mounting exercising unit comprises two swinging arms having a bottom end fastened to either end of a substantially U-shaped locating rod being fixed to the back of a chair by a knob controlled lock device and a slotted side extension plate in the middle at an outer side movably hung on a screw bolt at either end of a horizontal frame on the back of the chair and a top end coupled with a pulley wheel assembly, and two elastic pull ropes respectively inserted through either pulley wheel assembly and fastened to either swinging arm and an opposite end coupled with a handle.

DETAILED DESCRIPTION OF THE PREFERRED EMBODIMENT

Figure 1:
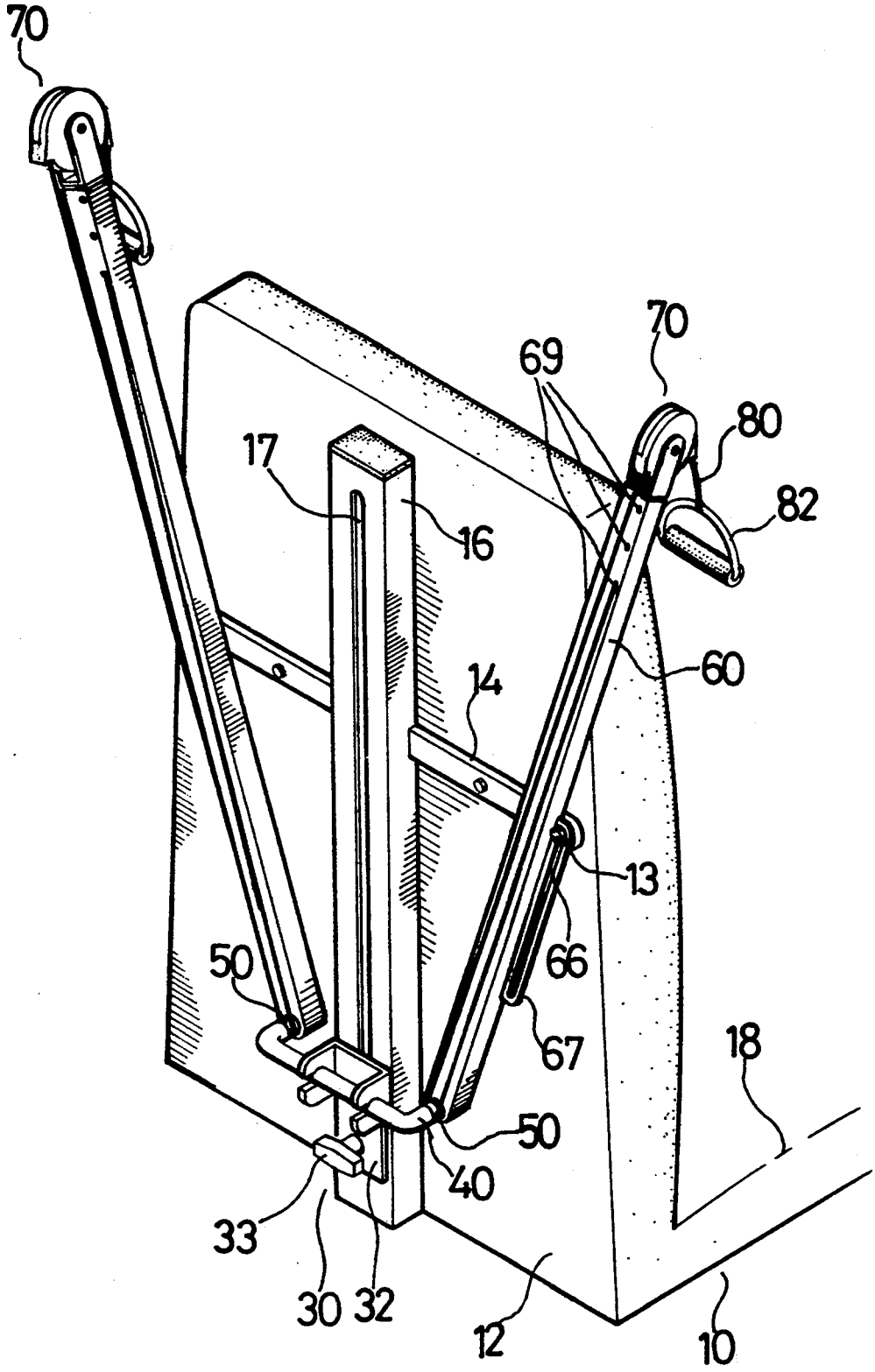
FIG. 1 is an elevational view of a chair mounting exercising unit according to the present invention.
Figure 2:
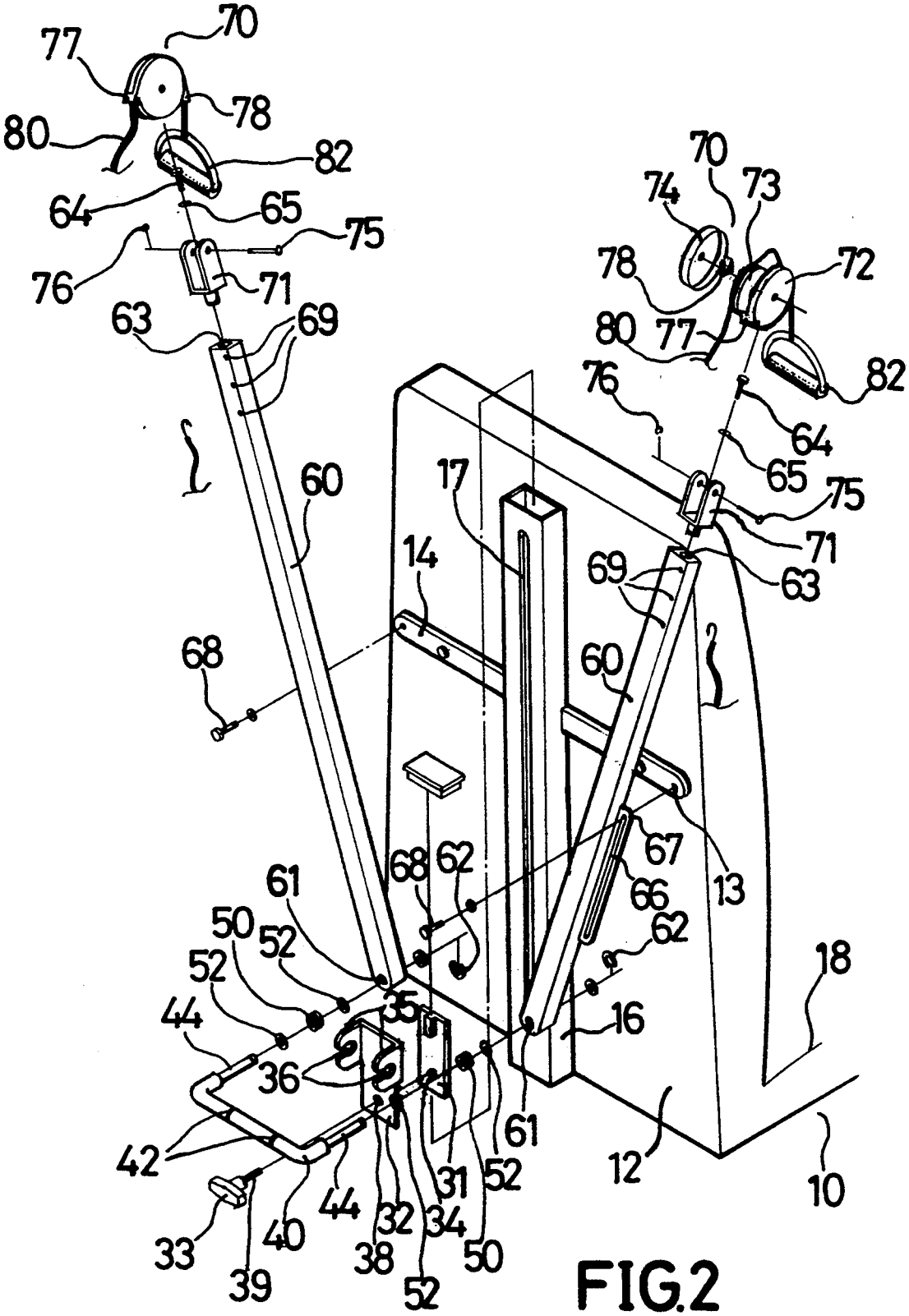
FIG. 2 is an exploded view of the chair mounting exercising unit shown in FIG. 1.
Figure 3:
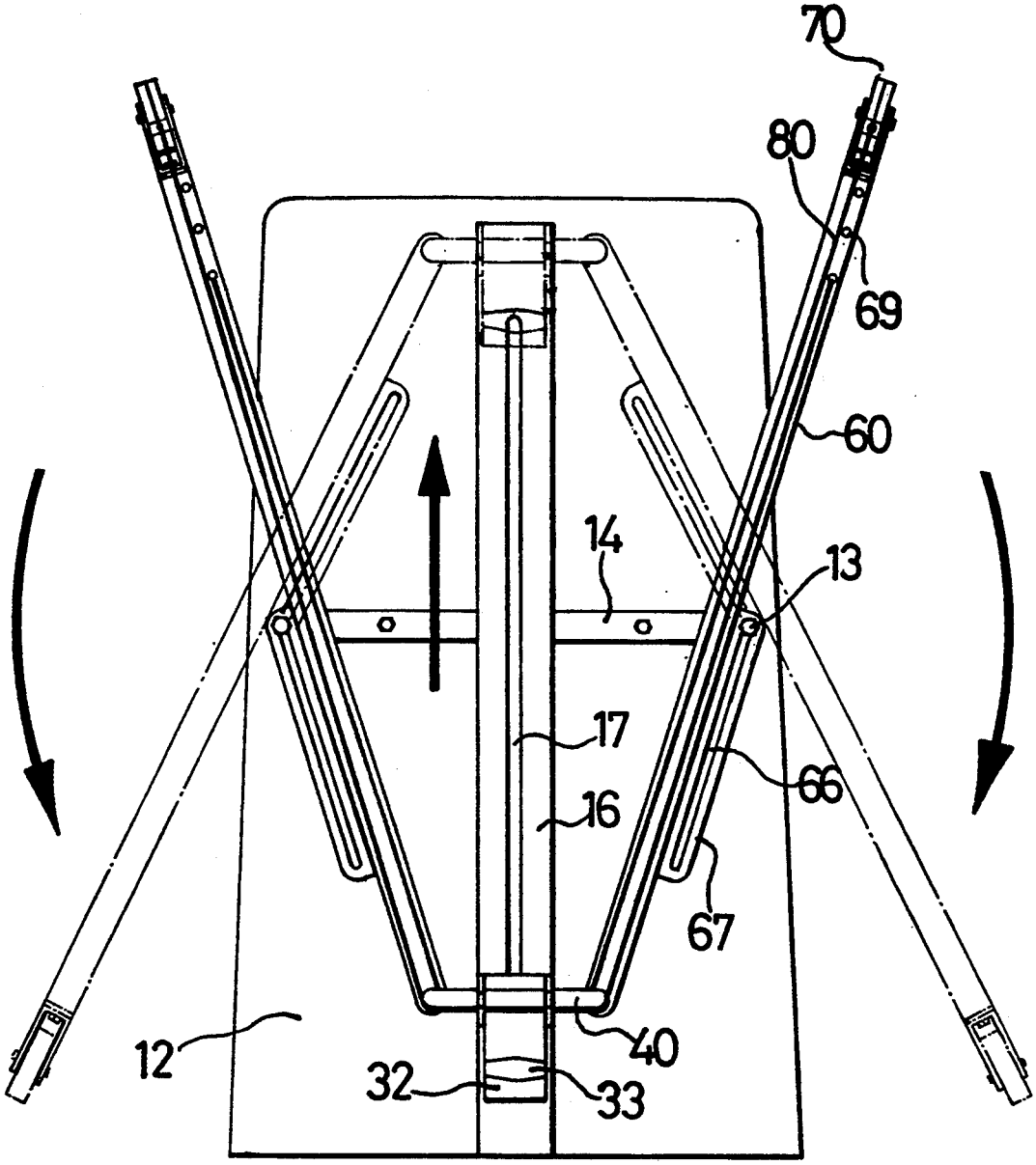
FIG. 3 shows the swinging arms of the chair mounting exercising unit shown in FIG. 1 adjusted.
Figure 4:
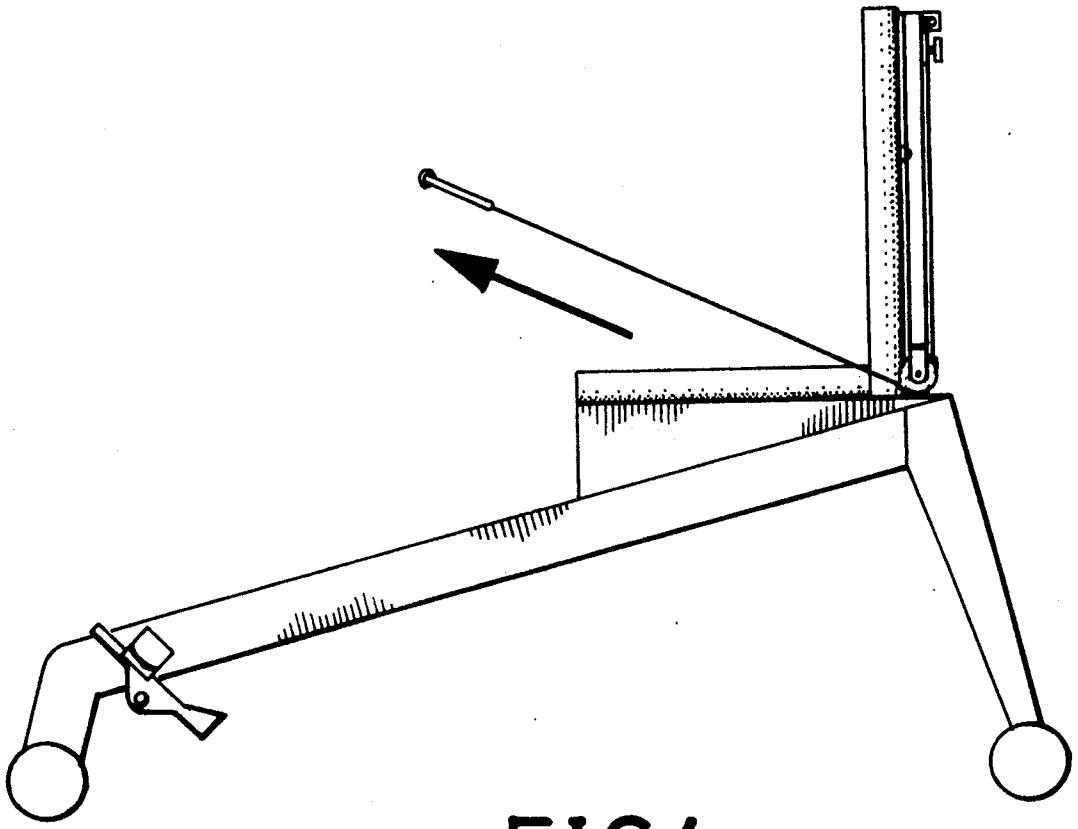
FIG. 4 shows the swinging arms of the chair mounting exercising unit shown in FIG. 1 adjusted.
Figure 5:
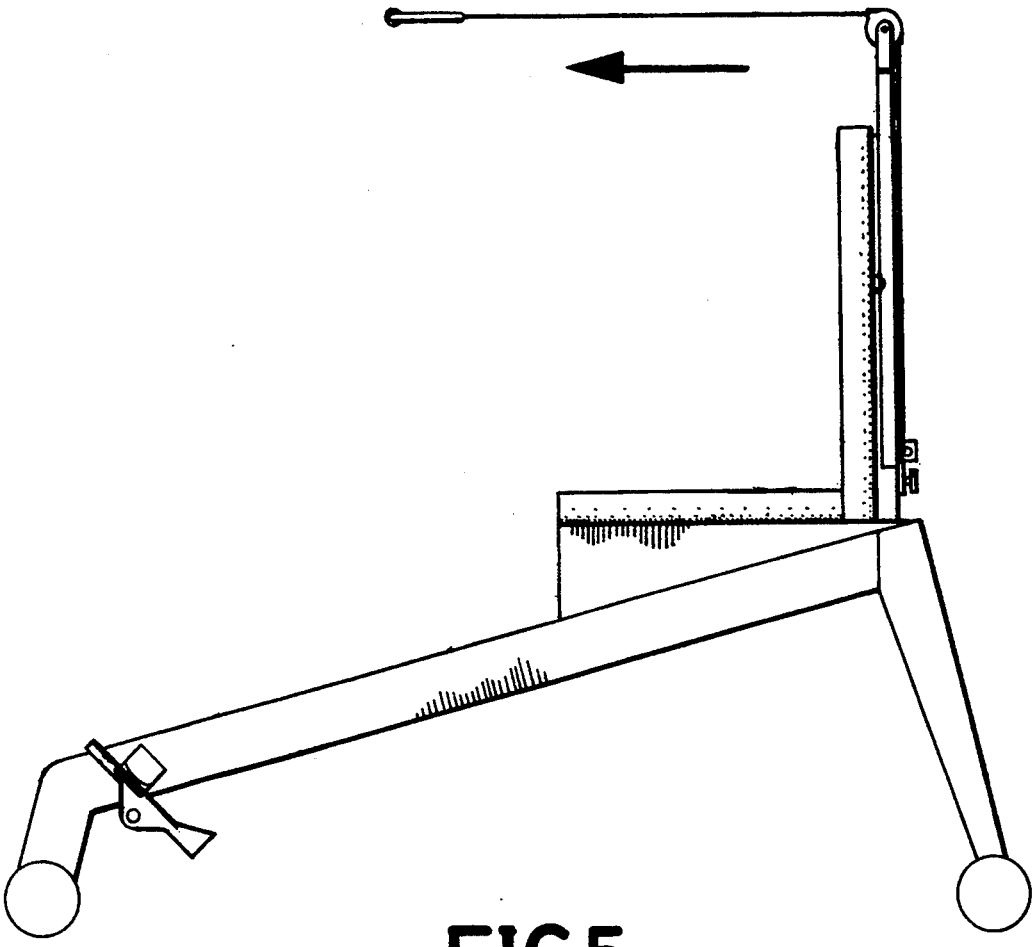
FIG. 5 shows the swinging arms of the chair mounting exercising unit shown in FIG. 1 adjusted.
Figure 6:
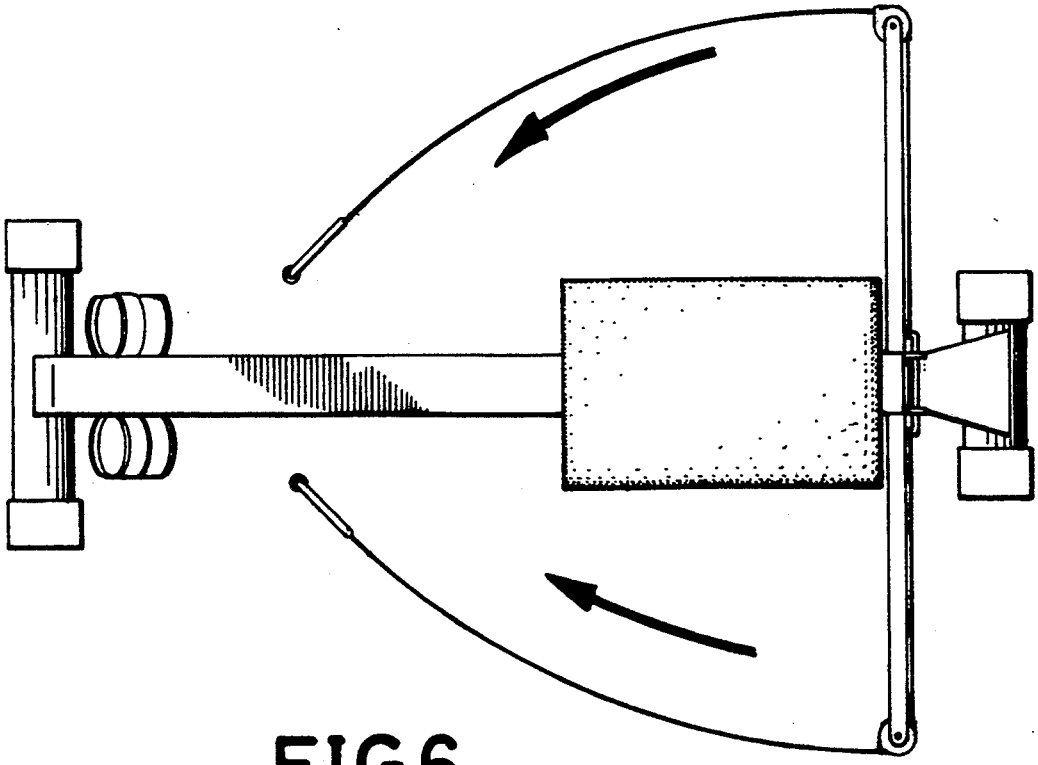
FIG. 6 shows the swinging arms of the chair mounting exercising unit shown in FIG. 1 adjusted.

Referring to FIGS. 1 and 2, an exercising unit 20 is mounted on the crossed frame, which consists of a horizontal frame 14 and a vertical frame 16, at the back 12 of the chair 10 so that when the user sits on the seat cushion 18 of the chair 10 can pull the exercising unit 20 to exercise the muscles of the chest and the back. The exercising unit 20 comprises a lock knob controlled mounting device 30, a substantially U-shaped locating rod 40, two locating wheels 50, two swinging arms 60, two pulley assemblies 70, and two elastic pull ropes 80.

The lock knob controlled mounting device 30 comprises a mounting plate 31, a slide block 32, and a lock knob 33. The mounting plate 31 is inserted into a longitudinal hole (not shown) inside the vertical frame 16, having a screw hole 34. The slide block 32 is made to slide along the outside wall of the vertical frame 16, comprising two parallel lugs 35 perpendicularly disposed at two opposite sides, and a through hole 38 corresponding to the screw hole 34 on the mounting plate 31. The lugs 35 have a respective circular mounting hole 36 and an opening 37 linked to the circular mounting hole 36, wherein the width of the opening 37 is shorter than the diameter of the circular mounting hole 36. The lock knob 33 has a screw rod 39 inserted through the through hole 38 on the slide block 32 and an elongated sliding slot 17 on the vertical frame 16, and then threaded into the screw hole 34 on the mounting plate 31 to fix the slide block 32 and the mounting plate 31 in position.

The locating rod 40 comprises two annular grooves 42 spaced around the periphery and engaged into the circular mounting holes 36 on the lugs 35 of the slide block 32, having two ends 44 bent at right angles and fastened to the back 12 of the chair 10 to hold the swinging arms 60.

The locating wheel 50 is mounted on either end 44 of the locating rod 40 by spring washers 52.

The swinging arm 60 is made of a rectangular bar having a through hole 61 near a bottom end thereof mounted on either end 44 of the locating rod 40 by a fastening element 62, a countersunk screw hole 63 on a top end thereof connected to either pulley wheel assembly 70 by a screw 64 and a washer 65. A side extension plate 67 with an elongated sliding slot 66 is fastened to the swinging arm 60 at an outer side in the longitudinal direction. A headed bolt 68 is inserted through the sliding slot 66 and threaded into a screw hole 13 on either end of the horizontal frame 14. Furthermore, a plurality of hanging holes 69 are made on the swinging arm 60 near the top end thereof.

The pulley wheel assembly 70 comprises a U-shaped pulley holder 71 fastened to either swinging arm 60 at the top, a casing formed of a case body 72 and a cover 74 and supported on the pulley holder 71, a pulley 73 received inside the casing 72;74 and revolvably supported on the pulley holder 71 by a screw bolt 75 and a nut 76. Furthermore, the casing 72;74 has a first wire hole 77 and a second wire hole 78 on two opposite locations for passing either elastic pull rope 80.

The elastic pull rope 80 has one end fastened to either hanging hole 69 on either swinging arm 60, and an opposite end inserted through the first wire hole 77 on the casing 72; 74 of either pulley wheel assembly 70 and wound round the respective pulley wheel 73 and then extended out of the second wire hole 78 and coupled with a handle 82.

Referring to FIGS. 3, 4, 5, and 6, when the lock knob 33 of the lock knob controlled mounting device 30 is loosened, the lock knob controlled mounting device 30 can be moved vertically along the elongated sliding slot 17 to change the positions of the swinging arms 60 relative to the back 12 of the chair 10. Because the side extension plate 67 of each swinging arm 60 is movably mounted on the respective headed bolt 68, when the lock knob controlled mounting device 30 is moved along the elongated sliding slot 17, the swinging arms 60 are simultaneously moved along a respective circular track passing through either headed bolt 68, and therefore the positions of the swinging arms 60 are symmetrically changed. Furthermore, the elastic pull ropes 80 can be fastened to either hanging hole 69 on either swinging arm 60 to change their tension so as to fit different requirements. When installed, the user sits on the seat cushion 18 of the chair 10 with both hands holding on the handles 82 to alternatively pull and release the elastic pull ropes 80 so as to exercise the muscles of the chest and the back.

Figure 7:
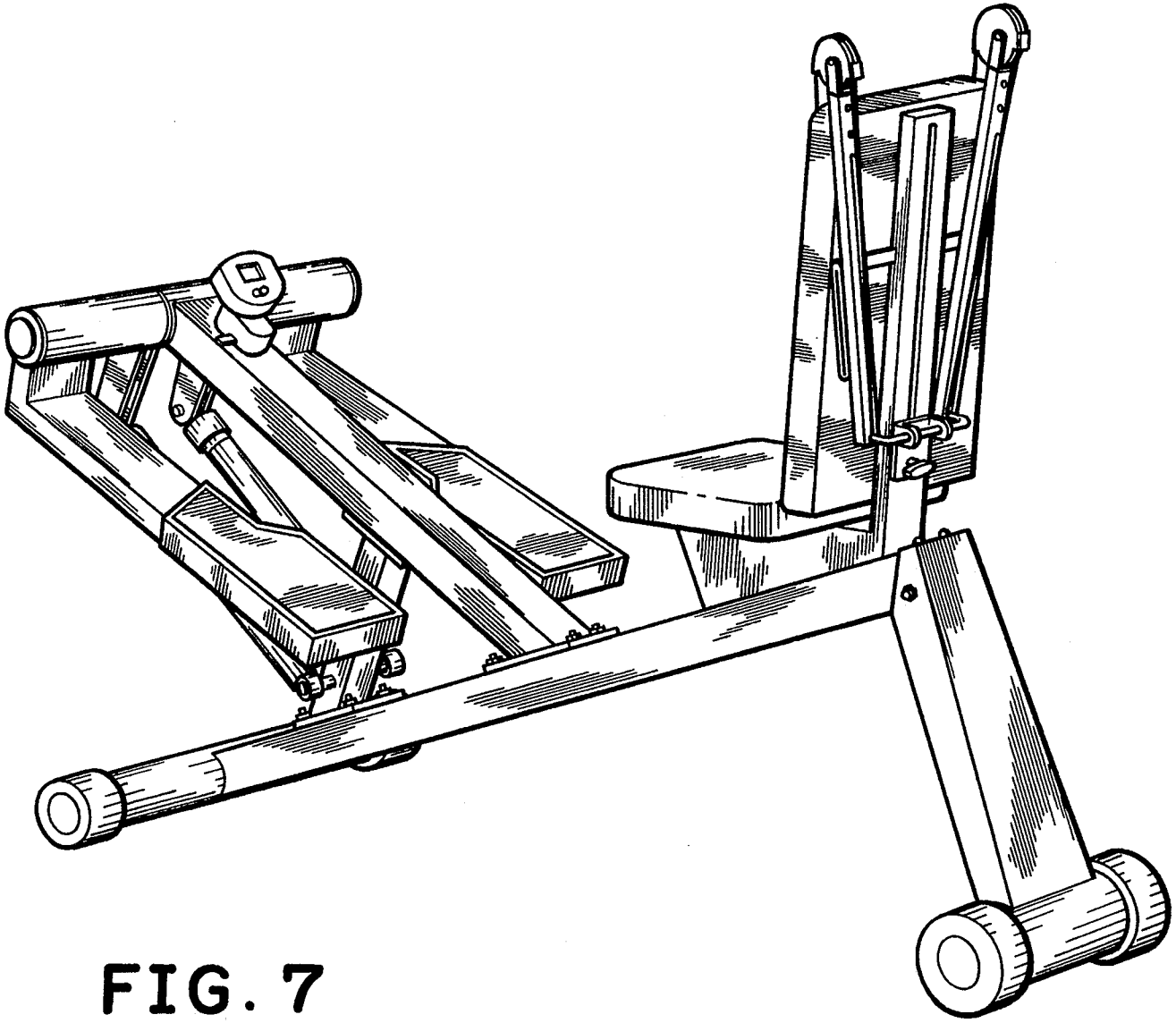
FIG. 7 shows an application of the present invention installed in a step exerciser.
Figure 8:
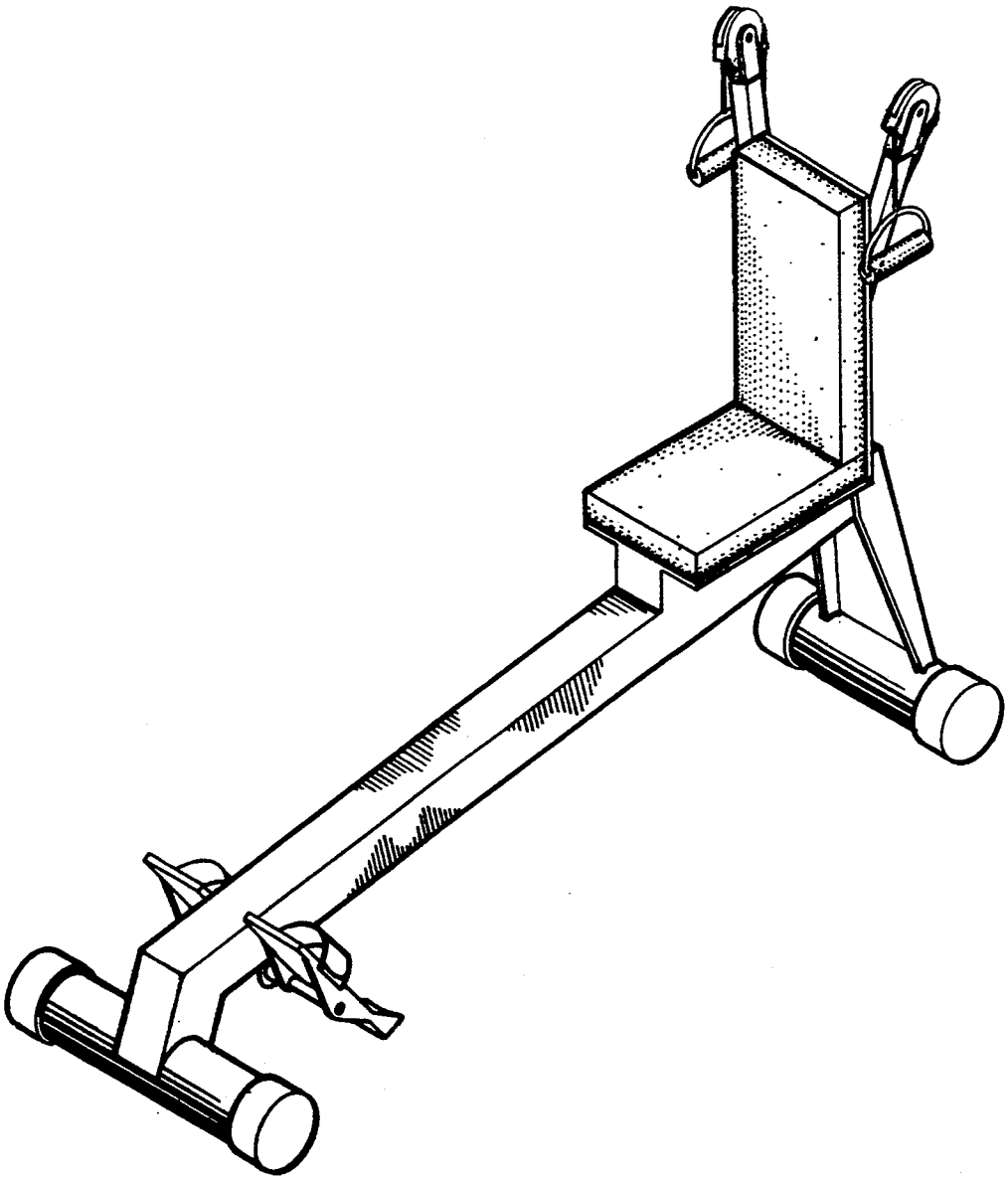
FIG. 8 shows another application of the present invention used as an independent exercising apparatus.

Referring to FIGS. 7 and 8, the aforesaid exercising unit may be installed in a step machine or separately installed as an independent exercising apparatus.

While only one embodiment of the present invention has been shown and described, it will be understood that various modifications and changes could be made without departing from the spirit and scope of the invention.

What is claimed is:

1. An exercising unit comprising:

a chair having a horizontal frame and a vertical frame crossed over a back wall thereof, said vertical frame having a longitudinal hole through the longitudinal axis thereof and an elongated sliding slot on a front wall thereof in communication with said longitudinal hole;

a lock knob controlled mounting device fastened to said vertical frame on said seat, said lock knob controlled mounting device comprising a mounting plate inserted into the longitudinal hole inside said vertical frame, a slide block made to slide along the elongated sliding slot on said vertical frame, and a lock knob to fasten said mounting plate and said slide block together and controlled to fix said lock knob controlled mounting device at any elevation within the elongated sliding slot on said vertical frame, said slide block having two opposite lugs at two opposite sides;

a locating rod having a rod body fastened to said lock knob controlled mounting device and supported between the lugs on said slide block in a horizontal position, and two opposite ends perpendicularly extended from said rod body in the same direction;

two locating wheels mounted on the two opposite ends of said locating rod;

two swinging arms having each a bottom end connected to either end of said locating rod and attached to either locating wheel, a top end, a series of longitudinally spaced hanging holes near the top and, a side extension plate with an elongated sliding slot, the side extension plate being hung on a respective headed bolt at either end of said horizontal frame on the back of said chair;

two pulley wheel assemblies respectively mounted on the top end of either swinging arm, each pulley wheel assembly comprising a pulley wheel holder fastened to the top end of either swinging arm, a casing supported on said pulley wheel holder, a suspension bolt inserted through a center hole on said casing and suspended on said pulley wheel holder, and a pulley wheel received inside said pulley wheel holder and turned on said suspension bolt, said casing having a first wire hole and a second wire hole on two opposite locations;

two elastic pull ropes having each one end fastened to either hanging hole on either swinging arm and an opposite end inserted through the first and second wire holes on the casing of either pulley wheel assembly and wound round the respective pulley wheel and then coupled with a respective handle; and wherein the positions of said swinging arms can be changed relative to the back of said chair by loosening said lock knob and moving said slide block and said mounting plate along the elongated sliding slot on said vertical frame.

2. The exercising unit of claim 1 wherein said chair is mounted on the frame of an exercising apparatus.

3. The exercising unit of claim 1 wherein said chair is mounted on a supporting frame permitting the exercising unit to be operated as an independent exercising apparatus.

* * * * *